US006048467A

United States Patent [19]

Dahmen et al.

[11] Patent Number: 6,048,467

[45] Date of Patent: Apr. 11, 2000

[54] LEATHER-TREATMENT AGENTS, PROCESS FOR THEIR PREPARATION, AND THEIR USE FOR PRODUCING LOW-FOGGING LEATHERS

[75] Inventors: Kurt Dahmen, Mönchengladbach; Thomas Müller, Meerbusch; Reinmar Peppmöller, Krefeld; Norbert Behlau, Mühlheim a.d. Ruhr, all of Germany

[73] Assignee: Stockhausen GmbH & Co. KG, Krefeld, Germany

[21] Appl. No.: 09/147,794

[22] PCT Filed: Sep. 8, 1997

[86] PCT No.: PCT/EP97/04863

§ 371 Date: Mar. 9, 1999

§ 102(e) Date: Mar. 9, 1999

[87] PCT Pub. No.: WO98/10103

PCT Pub. Date: Mar. 12, 1998

[30] Foreign Application Priority Data

Sep. 9, 1996 [DE] Germany ..... 196 36 494

[51] Int. Cl.[7] ..... C14C 9/00; C14C 9/02

[52] U.S. Cl. ..... 252/8.57

[58] Field of Search ..... 252/8.57; 36/45

[56] References Cited

U.S. PATENT DOCUMENTS

| | | | |
|---|---|---|---|
| 5,124,181 | 6/1992 | Schaffer et al. | 427/323 |
| 5,279,613 | 1/1994 | Schaffer et al. | 252/8.57 |
| 5,425,784 | 6/1995 | Denzinger et al. | 8/94.33 |
| 5,501,707 | 3/1996 | Schieferstein et al. | 8/94.23 |
| 5,558,675 | 9/1996 | Lauton | 252/8.57 |
| 5,914,442 | 6/1999 | Birkhofer et al. | 252/8.57 |

FOREIGN PATENT DOCUMENTS

| | | | |
|---|---|---|---|
| 889672 | 12/1981 | U.S.S.R. | 252/8.57 |

*Primary Examiner*—Anthony Green

*Attorney, Agent, or Firm*—Oblon, Spivak, McClelland, Maier & Neustadt, P.C.

[57] ABSTRACT

New leather dressing agents, which may be obtained by polymerization of a1) 70–100 wt. % acrylic acid and/or methacrylic acid and/or acid chlorides and/or anhydrides thereof with a2) 0–30 wt. % of other water-soluble monomers copolymerizable with a1), and a3) 0–20 wt. % of water-insoluble monomers copolymerizable with a1) and a2), reaction of the polymer with fatty amines, and neutralization and dispersion of the thus modified polymer, with amines not bound to the polymer optionally being reacted with (meth)acrylic acid to give N-substituted β-aminopropionic acids, production of said leather dressing agents and their use in the manufacture of low-fogging leathers.

21 Claims, No Drawings

LEATHER-TREATMENT AGENTS, PROCESS FOR THEIR PREPARATION, AND THEIR USE FOR PRODUCING LOW-FOGGING LEATHERS

The invention relates to new leather dressing agents for the manufacture of leathers having low contents of volatiles, particularly for car upholstery high-quality leathers, a process for producing said agents, and their use in manufacturing low-fogging leathers. Car upholstery leathers must meet specific criteria. On the one hand, softness is essential, as is light-fastness and resistance to heat influence on the other hand, and finally, the so-called fogging behavior. In DIN 75201, fogging is defined as condensation of volatiles evaporated from the vehicle interior equipment on the glass panes, particularly the windshield. That same standard also describes a gravimetric and a reflectometric procedure for characterizing the fogging behavior of leather.

EP 498,634 A2 recommends specific polymers for the manufacture of low-fogging leather, where the dispersions are substantially free of organic solvents and contain an amphiphilic copolymer consisting of a predominant part of at least one hydrophobic monomer and a minor part of at least one hydrophilic monomer. In a gravimetric test according to DIN 75201, the treatment of leather using these dispersions provides good results. There is no disclosure of reflectometric examinations.

The amphiphilic copolymers are preferably produced in an aqueous emulsion polymerization. However, due to the different hydrophilicity of the copolymers employed, this inherently gives rise to problems with the copolymerization behavior which, in the extreme case, may result in the situation that each of the monomers undesirably forms separate homopolymers. Another consequence of the per se unfavorable solution conditions is an expensive subsequent processing in order to destroy residual monomers. To achieve good emulsion stability, it is also necessary to add a sufficient amount of an emulsifier (lauryl sulfate was used in the examples mentioned), which may give rise to waste water problems in leather processing.

Furthermore, it is well-known to produce fat chemical raw materials by polymer-analogous reaction with fatty alcohols. Fundamental principles are described in Fat Sci. Technol. 92, No. 10, pp. 397–400. Even though possible fields of use have been discussed, applications in the manufacture of leather have not been described.

DE 42 05 839 A1 describes the reaction of polymers of a) 30–100 mole-% of unsaturated dicarboxylic anhydrides, b) from 0 to 70 mole-% of one or more vinylaromatics, c) 0–70 mole-% of vinyl esters of $C_1$–$C_8$ carboxylic acids, d) 0–50 mole-% of $C_2$–$C_6$ olefins, e) 0–30 mole-% of unsaturated $C_3$–$C_5$ carboxylic acids, and up to 10% of other copolymerizable monomers, with hydrophobic amines or alcohols. The resulting products impart particular softness to leathers treated therewith.

One drawback of this procedure is the high amount of poorly polymerizable dicarboxylic anhydrides, which is why severe conditions of polymerization must be chosen to obtain a low ratio of low molecular weight substances in the final product, which is required for good fogging behavior. This fact is confirmed by the data in the examples: polymerization temperature at the boiling point of the xylene solvent, about 136–140° C., at least 3 hours.

EP 466,392 B1 describes a process for the production of polymers which contain both lateral hydrophobic groups and lateral alkoxylated groups and are obtained according to common methods by a derivatization of polymers subsequent to the actual polymerization process. Thus, it is preferred to produce polymers from simple monomers such as acrylamide and/or acrylic acid using conventional polymerization, followed by derivatization using a mixture of primary or secondary hydrophobic amines and primary or secondary alkoxylated amines. Such polymer derivatives are used as thickening agents and dirt-solving agents.

It was therefore the object of the invention to provide new leather dressing agents which are easy to produce, substantially auto-emulsifying and low in residual monomers, a process for their production, and a process for manufacturing leather using said agents, wherein leathers are obtained which have exceedingly low contents of evaporating volatiles (low-fogging leather), as determined according to both gravimetric and reflectometric measuring procedures, the other important properties of leather, such as softness, light-fastness and resistance to heat influence etc. not being impaired.

The invention is directed to new leather dressing agents, particularly for car upholstery leather, which may be obtained by A) Polymerization of a1) 70–100 wt.-% acrylic acid and/or methacrylic acid and/or the acid chlorides and/or anhydrides thereof with a2) 0–30 wt.-% of other water-soluble monomers copolymerizable with a1), and a3) 0–20 wt.-% of water-insoluble monomers copolymerizable with a1) and a2), B) reaction of the polymer from A) with amines of formula I $$R_1—NH—R_2$$

wherein $R_1$ represents a $C_{12}$–$C_{30}$ alkyl or alkenyl residue, and $R_2$ represents H, a $C_1$–$C_4$ alkyl or $C_1$–$C_2$ hydroxyalkyl residue, optionally C) reaction of the amines not bound to the polymer from A) with (meth)acrylic acid to give N-substituted β-aminopropionic acids and optionally, acylation, D) neutralization and dispersion of the product obtained from B) and C), respectively.

The invention is also directed to a process for the production of leather dressing agents, characterized in that the monomers a1), a2) and a3) are subjected to free-radical polymerization, preferably in solution, the polymer obtained is then reacted either immediately or subsequent to solvent removal with the amines of formula $R_1$—NH—$R_2$, wherein $R_1$ and $R_2$ have the meanings indicated in claim 1, at least part of the acid groups present in the polymer being converted to the corresponding amide groups, followed by partial or complete neutralization of the remaining carboxyl groups using dilute base, optionally with addition of water.

Step A: Polymerization

The polymers are produced by free-radical polymerization of 70–100 wt.-%, preferably more than 80 wt.-%, relative to the total batch, of acrylic acid and/or methacrylic acid and/or the acid chlorides and/or anhydrides thereof.

To improve the polymers with respect to the desired properties in leather treatment, particularly fogging behavior, from 0 to 30 wt.-% of other copolymerizable water-soluble monomers are incorporated by polymerization.

Examples of suitable monomers of this group are (meth) acrylamide, (meth)allyl alcohol, hydroxyethyl (meth) acrylate, hydroxypropyl (meth)acrylate, hydroxyalkylpolyethyleneoxy (meth)acrylate, alkyloxypolyethyleneoxy (meth)acrylate, polyethylene glycol monoallyl ether, N-vinylpyrrolidone, or N-vinylimidazole.

Other monomers containing acid groups, such as maleic acid, itaconic acid, vinylsulfonic acid, methallylsulfonic acid, 2-acrylamido-2-methylpropylsulfonic acid, 4-vinylphenylsulfonic acid, vinylphosphonic acid, as well as the water-soluble esters, anhydrides, alkali, alkaline earth and/or ammonium salts thereof may also be used.

Furthermore, it may be useful to employ basic monomers in the polymerization, such as dimethylaminoalkyl (meth) acrylate and/or dimethylaminoalkyl (meth)acrylamide and/or the quaternary forms thereof.

Naturally, the polymers of these monomers are highly hydrophilic in character. Therefore, it may be useful to act on hydrophilicity by employing from 0 to 20 wt.-% of one or more monomers from the group of hydrophobic monomers. For example, this group comprises $C_1$–$C_{30}$ alkyl (meth)acrylates, vinyl esters of $C_1$–$C_{30}$ carboxylic acids, vinyl ethers of $C_1$–$C_{30}$ alcohols, or ethylenically unsaturated aromatic monomers such as styrene.

The polymerization itself may be effected according to the processes of bulk, solution, suspension or emulsion polymerization. The solution polymerization process is preferred, where the solvent must fulfill the provision of being able to dissolve all the monomers employed. Accordingly, water, $C_1$–$C_4$ alcohols and their ethylene oxide adducts, glycols and ketones such as acetone or methyl ethyl ketone are suitable, with higher boiling organic solvents being preferred due to their more favorable fogging behavior in the final product. It is particularly preferred to use ethylene glycol butyl ether and diethylene glycol butyl ether as solvents in the polymerization.

The polymerization may be carried out batchwise as well as in continuous operation, using a tank reactor cascade, for example. If the reaction is carried out batchwise, a feeding procedure is preferred where monomers and initiator are metered into the vessel over a period of several hours at constant temperature. In addition, however, an adiabatic operation is also possible, where the monomers are precharged completely or partially, and the generated polymerization heat results in a temperature rise and a more rapid reaction of the monomers in the batch.

The initiation of the free-radical polymerization is triggered by common initiators, e.g., by thermal or photochemically induced decomposition of radical-forming peroxide and/or azo compounds and/or by suitable redox systems, the selection of the suitable system depending on the designated reaction temperature and the reaction rate. In adiabatic polymerization of the monomers, it may be useful to employ multiple initiators, e.g., those having different decomposition temperatures. As a rule, those systems having sufficient solubility in the reaction medium will be preferred. The amount of initiator preferably ranges from 0.01 to 1 wt.-%, relative to the total of monomers.

The molar weight of the polymers is controlled via reaction conditions and/or by using modifiers such as mercaptans. The amount of modifier preferably ranges from 0 to 5 wt.-%, relative to the total of monomers.

The number average molar weight of the polymers obtained are between 1,000 and 100,000 g/mole, as determined by gel permeation chromatography.

Reaction temperatures ranging from 20 to 200° C. are preferred and optionally, the polymerization may also be performed under pressure. Preferably, the polymerization times are 0.5–8 hours.

The polymerization is either followed by immediate polymer-analogous reaction of the polymer according to step B), or the solvent is separated from the polymer first, e.g., by distillation. When polymerizing in aqueous medium, the latter is necessary in order to achieve sufficient conversion in the subsequent reaction of the polymer.

Step B: Reaction with Fatty Amines

In this reaction step according to the invention, part of the polymer acid groups present is converted to the corresponding amide groups by reaction with fatty amines of formula I:

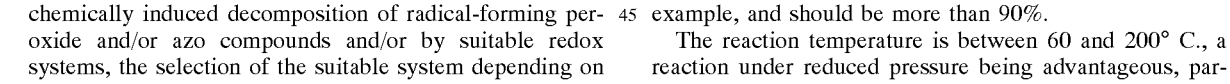

$$R_1—NH—R_2 \qquad \text{I}$$

wherein $R_1$ represents a $C_{12}$–$C_{30}$ alkyl or alkenyl residue, and $R_2$ represents H, a $C_1$–$C_4$ alkyl residue or a $C_1$–$C_2$ hydroxyalkyl residue.

In contrast to the use of fatty alcohols according to DE 42 05 839 A1, significantly improved product stability has been observed when fatty amines were used according to the invention.

The amount of fatty amine employed according to the invention determines the softness degree of the leather. The more acid groups of the polymer are modified by reaction with one or more fatty amines, the softer the leather treated therewith. However, since there is an influence on the auto-emulsifiability of the polymer formed, not all of the carboxyl groups of the polymer should be reacted in this fashion. Reacting an amount of from 20 to 80 mole-% relative to the carboxyl groups present in the polymer has proven advantageous in experiments.

In addition to the amount of fatty amine employed, the length of the alkyl chain has an influence on the achievable softness. In general, alkyl chains having 12–30 C atoms provide good usability of these agents. For especially soft types of leather, fatty amines having a carbon number between 16 and 22 are preferred. Particularly preferred in the polymer-analogous reaction is the use of oleylamine and stearyl-amine.

The reaction of the polymers with the fatty amines is preferably performed in the presence of acid catalysts, e.g., with p-toluenesulfonic acid. The amount of catalyst should not exceed 1 mole-%, based on carboxyl groups present.

The reaction time depends on the desired conversion which may be monitored by thin layer chromatography, for example, and should be more than 90%.

The reaction temperature is between 60 and 200° C., a reaction under reduced pressure being advantageous, particularly at lower reaction temperatures. In order to achieve conversions of more than 99%, it may be required to remove the produced reaction water azeotropically.

Step C: Reaction of Residual Fatty Amine to N-substituted β-aminopropionic Acids This optional step is carried out in those cases where a particularly low content of residual amine is required in the final product. Here, the residual amines are reacted with (meth)acrylic acid and optionally, the amines not bound to the polymer from A) or the produced N-substituted β-aminopropionic acids are acylated. The details of this reaction have been described in DE 37 17 961 C2. One advantage of this step is that achieving low amounts of residual amine during step B is not necessarily required, which is why operation may also be effected using excess fatty amine, i.e., more than 80 mole-%, relative to the carboxyl groups.

Step D: Neutralization and Dispersion

Subsequent to the polymer-analogous reaction, the remaining carboxyl groups are neutralized partially or completely, using dilute base, optionally with addition of water, the polymer being dispersed and/or dissolved. Suitable neutralizing agents are alkali and alkaline earth hydroxides, ammonia, amines or aminoalcohols. The amount of base is selected such that a pH value between 5 and 9 is established. The aqueous emulsions according to the invention are adjusted to a solids content of from 20 to 80 wt.-%.

The invention also relates to the use of the agents of the invention in the manufacture of upper leathers having low contents of evaporating volatiles, particularly car upholstery leathers.

The agents of the invention which contain these modified polymers may either be used as such or in combination with other stuffing agents in the manufacture of car upholstery leathers.

In addition to the manufacture of car upholstery leathers, the products of the invention are also suited for manufacturing hydrophobized upper leathers or clothing washable leathers. The required amount of the products is from 2 to 20 wt.-%, preferably 5–15 wt.-%, based on the shaving weight of the leather. They are normally employed at the stuffing stage of leather processing.

The following embodiments are intended to illustrate the invention, without limiting the inventive idea. All the numerical data in the examples relate to amounts by weight, unless otherwise stated.

EXAMPLE 1

45.0 g of ethylene glycol butyl ether is placed in a reactor equipped with anchor stirrer, metering units, internal thermometer and distillation column and heated to about 80° C. Thereafter, the following supplies are started:

Supply 1: 72.0 g (1.0 moles) of acrylic acid

Supply 2: 9.0 g (0.1 moles) of mercaptoethanol

Supply 3: 0.5 g (3.0 mmoles) of azobisisobutyronitrile in 15 g of ethylene glycol butyl ether The metering time is about one hour. Stirring is continued for another 30 minutes at 80° C. and subsequently, 58 g (0.22 moles) of oleylamine and 0.4 g of p-toluenesulfonic acid are added. The temperature is raised to 150° C., and the batch is stirred for 4 hours, with 15 g of distillate being withdrawn. After four hours, the batch was checked using thin layer chromatography. A residual amine content of 5%, based on overall product, corresponding to a conversion of about 85% was found. Cooling to about 95° C. was effected. Thereafter, 2.0 g of acrylic acid was added, followed by addition of 1.8 g of maleic anhydride. Stirring was continued for another hour and eventually, the product was neutralized with 50 g of sodium hydroxide solution (50%) and 350 g of water and dispersed. A clear yellow product was obtained, having about 35% of dry substance wherein no residual amine could be detected anymore. The pH value was 6.8.

EXAMPLE 2

Example 1 was repeated, but 0.5 g of hypophosphorous acid was added as catalyst for the amidation. After the polymer-analogous amidation, a residual amine content of 0.8% was found and therefore, reaction with acrylic acid and MSA was refrained. A clear yellow product was obtained, having an active substance of 40 wt.-% and a pH value of 6.6.

EXAMPLE 3

Example 1 was repeated, but 110 g of oleylamine (0.42 moles) was employed. A yellow emulsion was obtained, having a pH value of 7.5 and an active substance of 40 wt.-%.

EXAMPLE 4

This example corresponds to Example 1, but 60 g of a low-fogging sulfited fish oil was added at the end of the reaction. A light brown clear solution was obtained, having an active substance of 40% and a pH value of 6.6.

EXAMPLE 5

Manufacture of a Car Upholstery Leather

Starting material cow wet-blue, shaving thickness from 1.0 to 1.2 mm, percentages relate to the shaving weight.

| | | |
|---|---|---|
| 1) Washing | 300% water, 40° C.,<br>0.3% degreasing agent | 10 min |
| Discharge liquor | | |
| 2) Retanning 1 | 100% water, 40° C.<br>4% chromium syntan<br>1.5% dispersion aid<br>+2% resin retanning material | 30 min<br><br><br>45 min |
| Discharge liquor | | |
| 3) Neutralization<br>Retanning 2 | 100% water, 35° C.<br>1% resin retanning material<br>+1.2% sodium bicarbonate<br>+3.0% syntan, light-fast<br>1.5% vegetable tanning material | 10 min<br><br>50 min<br><br>45 min |
| Discharge liquor | | |
| 4) Washing | 300% water, 60° C. | 10 min |
| Discharge liquor | | |
| 5) Stuffing | +6.5% active substance/stuffing agent 1:4<br>+1.5% formic acid | 60 min<br>30 min |
| Final pH of liquor 3.5–3.9 | | |
| Discharge liquor | | |
| 7) Washing | 300% water, 20° C. | 10 min |

The leathers are wet-stretched on a horse overnight, dried, wetted, staked and milled.

A low-fogging polymer stuffing agent (C1: marketed product "Magnopal®" SOF, manufactured by Stockhausen GmbH & Co. KG) and a low-fogging stuffing agent based on fish oils (C2: marketed product "Chromopol®" LFC, manufactured by Stockhausen GmbH & Co. KG) were used as comparative examples (state of the art).

Table of results:

| | Example 2 | Example 4 | Comp. Ex. 1 | Comp.Ex. 2 |
|---|---|---|---|---|
| Softness | 2 | 2+ | 2+ | 2+ |
| Grain pattern | | fine to medium, uniform | | |
| Fogging results according to DIN 75201 B (gravimetrically) | 1.2 | 1.5 | 3.9 | 3.5 |
| according to DIN 75201 A (reflectometrically) | 51% | 55% | 34% | 40% |
| Light-fastness | | | | |
| after 8 hrs | >3 | 1–2 | >3 | 1 |
| after 24 hrs | 4–5 | 2 | 4 | 1 |

Notes on the above values:
Softness: assessment according to the (German) school grading system (1: very good; 6: unsatisfactory)
Fogging, gravimetrically: data in mg/50 $cm^2$
Light-fastness: According to DIN 54004, assessment using blue standard under daylight lamp, lower figures correspond to stronger yellowing.

The table shows that the products of the invention are superior to the prior art products in at least one criterion.

We claim:

1. Leather dressing agent obtained by

A) polymerization of a1) 70–100 wt. % of at least one of (meth)acrylic acid, acid chlorides thereof, and anhydrides thereof with a2) 0–30 wt. % of other water-soluble monomers copolymerizable with a1), and a3) 0–20 wt. % of water-insoluble monomers copolymerizable with a1) and a2), to form a polymer, B) reaction of the polymer from A) with amines of formula1

$$R_1—NH—R_2$$

wherein $R_1$ represents a $C_{12}$–$C_{30}$ alkyl or alkenyl residue, and $R_2$ represents H, a $C_1$–$C_4$ alkyl or $C_1$–$C_2$ hydroxyalkyl residue, optionally C) reaction of the amines not bound to the polymer from A) with (meth)acrylic acid to give N-substituted β-aminopropionic acids and optionally, acylation of the amines not bound to the polymer from A), or the N-substituted β-aminopropionic acids formed, D) neutralization and dispersion, of, the product obtained from B) and if C) is carried out, of the product obtained from C).

2. Leather dressing agent according to claim 1, obtained by A) polymerization of 80–100 wt. % of monomer a1).

3. Leather dressing agent according to claim 1, obtained by A) polymerization of at least one comonomer selected from the group consisting of (meth)acrylamide, (meth)allyl alcohol, hydroxyethyl (meth)acrylate, hydroxypropyl (meth)acrylate, hydroxyalkylpolyethyleneoxy (meth) acrylate, alkyloxypolyethyleneoxy (meth)acrylate, polyethylene glycol monoallyl ether, N-vinylpyrrolidone and N-vinylimidazole as comonomers a2).

4. Leather dressing agent according to claim 1, obtained by polymerization of monomers containing acid groups, selected from the group consisting of maleic acid, itaconic acid, vinylsulfonic acid, methallylsulfonic acid, 2-acrylamido-2-methylpropylsulfonic acid, 4-vinylphenylsulfonic acid, vinylphosphonic acid and water-soluble esters, anhydrides, alkali, alkaline earth and ammonium salts of said acids as comonomers a2).

5. Leather dressing agent according to claim 1, obtained by A) polymerization of basic monomers, selected from the group consisting of dimethylaminoalkyl (meth)acrylate, quaternary forms thereof, dimethylaminoalkyl (meth) acrylamide, and quaternary forms thereof as comonomers a2).

6. Leather dressing agent according to claim 1, obtained by A) polymerization of at least one comonomer selected from the group consisting of $C_1$–$C_{30}$ alkyl (meth)acrylates, vinyl esters of $C_1$–$C_{30}$ carboxylic acids, vinyl ethers of $C_1$–$C_{30}$ alcohols and ethylenically unsaturated aromatic monomers, as comonomers a3).

7. Leather dressing agent according to claim 1, obtained by solution polymerization in a solvent wherein all the monomers employed are soluble.

8. Leather dressing agent according to claim 1, obtained by solution polymerization in ethylene glycol butyl ether and/or diethylene glycol butyl ether as solvent.

9. Leather dressing agent according to claim 1, wherein 20–80 mole % of carboxyl groups present in the polymer are reacted with amines of formula $R_1$—NH—$R_2$.

10. Leather dressing agent according to claim 1, which is an aqueous solution or emulsion having a pH value ranging from 5 to 9 and a content of polymer of 20–80 wt. %, calculated as solid matter.

11. Leather dressing agent according to claim 6, wherein at least one comonomer a3) is styrene.

12. A process for producing a leather dressing agent obtained by

A) polymerization of a1) 70–100 wt. % of at least one of(meth)acrylic acid, acid chlorides thereof, and anhydrides thereof with a2) 0–30 wt. % of other water-soluble monomers copolymerizable with a1), and a3) 0–20 wt. % of water-insoluble monomers copolymerizable with a1) and a2), to form a polymer, B) reaction of the polymer from A) with amines of formula $$R_1—NH—R_2$$

wherein $R_1$ represents a $C_{12}$–$C_{30}$ alkyl or alkenyl residue, and $R_2$ represents H, a $C_1$–$C_4$ alkyl or $C_1$–$C_2$ hydroxyalkyl residue, optionally C) reaction of the amines not bound to the polymer from A) with (meth)acrylic acid to give N-substituted β-aminopropionic acids and optionally, acylation of the amines not bound to the polymer from A), or the N-substituted β-aminopropionic acids formed, D) neutralization and dispersion, of, the product obtained from B) and if C) is carried out, of the product obtained from C), wherein the monomers a1), a2) and a3) are subjected to free-radical polymerization, the polymer obtained is then reacted either immediately or subsequent to solvent removal with the amines of formula $R_1$—NH—$R_2$, wherein $R_1$ and $R_2$ have the above meanings, at least part of acid groups present in the polymer being converted to amide groups, followed by partial or complete neutralization of remaining carboxyl groups using dilute base, optionally with addition of water.

13. The process according to claim 12, wherein prior to neutralization and dispersion, residual amine is reacted with (meth)acrylic acid and optionally, subsequently acylated.

14. The process according to claim 12, wherein the reaction of the polymer with the amines of formula $R_1$—NH—$R_2$ is performed at temperatures of from 60 to 200° C., optionally under reduced pressure and/or with azeotropic removal of reaction water produced.

15. The process according to claim 12, wherein a pH value of from 5 to 9 is finally adjusted using dilute base, with dispersion or solution of the product.

16. The process according to claim 12, wherein said free-radical polymerization is carried out in solution.

17. The process according to claim 12, wherein the dilute base is selected from the group consisting of alkali and alkaline earth metal hydroxides, ammonia, amines and amino alcohols.

18. In a process of manufacturing of upper leathers with a leather dressing agent, the improvement comprising leather dressing with the leather dressing agent according to claim 1.

19. The process of claim 18, wherein the upper leathers are car upholstery leathers.

20. The process of claim 18, wherein said dressing agent is used in an amount of from 2–20 wt %, based on a shaving weight of the leather, at a stuffing stage of said manufacturing.

21. The process according to claim 20, wherein the amount is 5–15 wt %.

* * * * *